US008550480B1

(12) United States Patent
Bonilla

(10) Patent No.: US 8,550,480 B1
(45) Date of Patent: Oct. 8, 2013

(54) SKATEBOARD WITH TRUCKS MOUNTED ABOVE DECK

(76) Inventor: Carlos Bonilla, Hacienda Heights, CA (US)

( * ) Notice: Subject to any disclaimer, the term of this patent is extended or adjusted under 35 U.S.C. 154(b) by 86 days.

(21) Appl. No.: 13/312,798

(22) Filed: Dec. 6, 2011

(51) Int. Cl.
*B60G 7/02* (2006.01)

(52) U.S. Cl.
USPC ..... 280/87.042

(58) Field of Classification Search
None
See application file for complete search history.

(56) References Cited

U.S. PATENT DOCUMENTS

| | | | | | |
|---|---|---|---|---|---|
| D252,346 | S | * | 7/1979 | Solheim | D21/765 |
| D252,347 | S | * | 7/1979 | Solheim | D21/765 |
| 4,398,734 | A | * | 8/1983 | Barnard | 280/11.28 |
| 4,596,396 | A | * | 6/1986 | Merbler | 280/11.28 |
| 5,794,955 | A | * | 8/1998 | Flynn | 280/87.042 |
| 5,833,252 | A | * | 11/1998 | Strand | 280/87.042 |
| 6,669,215 | B2 | * | 12/2003 | Laporte | 280/87.042 |
| 7,070,193 | B2 | * | 7/2006 | Yamaguchi | 280/87.042 |
| 7,226,063 | B2 | * | 6/2007 | Paddock | 280/87.042 |
| 7,484,741 | B2 | * | 2/2009 | Kay, III | 280/87.042 |
| 7,766,351 | B2 | * | 8/2010 | Chen et al. | 280/87.042 |
| D629,859 | S | * | 12/2010 | Buksa | D21/765 |
| 2003/0155733 | A1 | * | 8/2003 | Tan et al. | 280/87.042 |
| 2007/0126191 | A1 | * | 6/2007 | Kay | 280/11.27 |
| 2010/0140885 | A1 | * | 6/2010 | Corrente | 280/11.27 |

* cited by examiner

*Primary Examiner* — John R Olszewski
*Assistant Examiner* — Hilary L Johns
(74) *Attorney, Agent, or Firm* — Kenneth L. Green

(57) ABSTRACT

A skateboard provides a snowboard like ride. A truck support structure is attached to the top of the deck and the trucks are mounted to the support structure spaced away from the deck to provide clearance for turning. The truck support structure is adjustable to allow individual riders to adjust the skateboard to their preference. In one embodiment, the trucks are mounted above a longboard deck.

21 Claims, 6 Drawing Sheets

SKATEBOARD WITH TRUCKS MOUNTED ABOVE DECK

BACKGROUND OF THE INVENTION

The present invention relates to skateboards and in particular to a longboard skateboard providing a snowboard like ride.

Skateboards are commonly used in recreational activities such as cruising, down hill events, and the like. Known longboard skateboards are very similar to shortboards, the main difference being the length of the deck. While the longboard skateboards provide an enjoyable alternative to shortboards, known designs do not take full advantage of the longer deck length. Many skateboard riders enjoy snowboarding during the winter, but unfortunately, known longboard skateboards provide a riding experience unlike riding a snowboard. Therefore, a need exists for a longboard skateboard design taking full advantage of the deck length to provide a snowboard like ride.

BRIEF SUMMARY OF THE INVENTION

The present invention addresses the above and other needs by providing a skateboard which provides a snowboard like ride. A truck support structure is attached to the top of the deck and the trucks are mounted to the support structure spaced away from the deck to provide clearance for turning. The truck support structure is adjustable to allow individual riders to adjust the skateboard to their preference. In one embodiment, the trucks are mounted above a longboard deck.

In accordance with one aspect of the invention, there is provided a longboard skateboard. The longboard skateboard includes a longboard deck having a top surface and narrow front and rear portions, truck assemblies attached to the longboard deck, the truck assemblies comprising, and reliefs on the top surface of the deck aligned with the truck axles, the reliefs reaching to outside edges. The truck assemblies include truck plate portions spaced apart from top surface of the deck and trucks residing between the truck plate portions and the top surface of the deck, the truck assemblies adjustable to vary the clearance of the trucks with respect to the top surface of the deck.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 2:
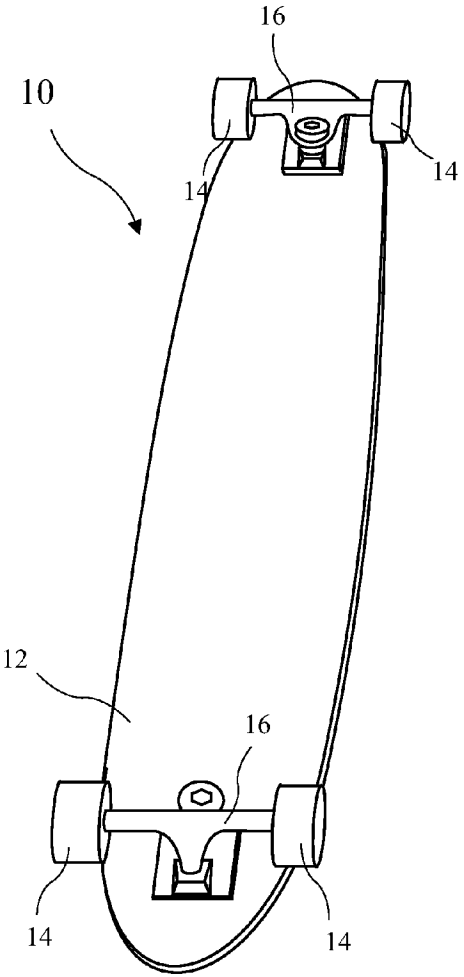
FIG. 2 (prior art)
FIG. 2 is a bottom perspective view of the prior art skateboard.
Figure 1:
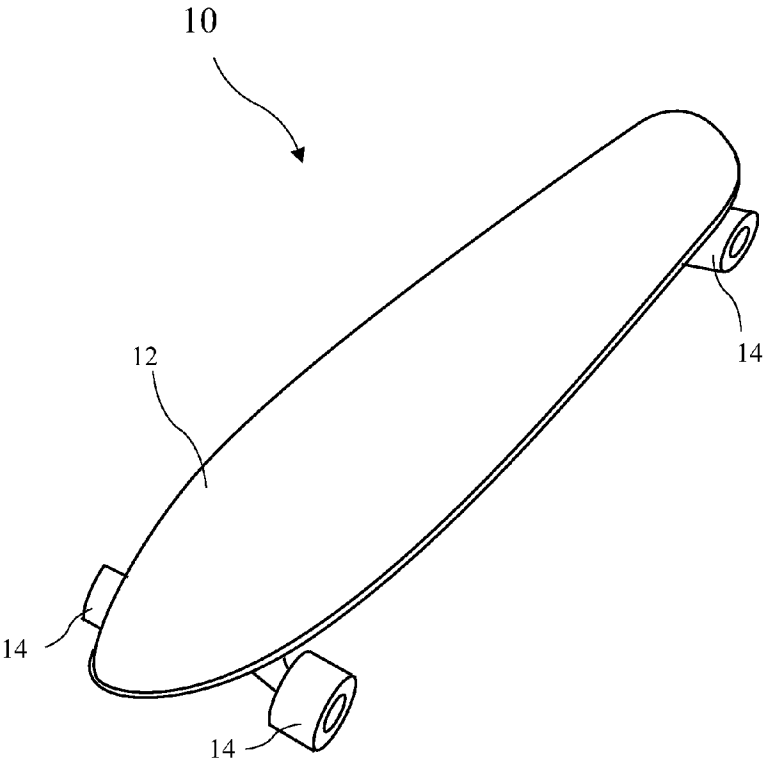
FIG. 1 (prior art)
FIG. 1 is a top perspective view of a prior art skateboard.

A top perspective view of a prior art skateboard 10 is shown in FIG. 1 and a bottom perspective view of the prior art skateboard 10 is shown in FIG. 2. The skateboard 10 includes a deck 12, trucks 16 mounted to the forward and rear ends of the deck, and wheels 14 mounted to the trucks 16.

Figure 3A:
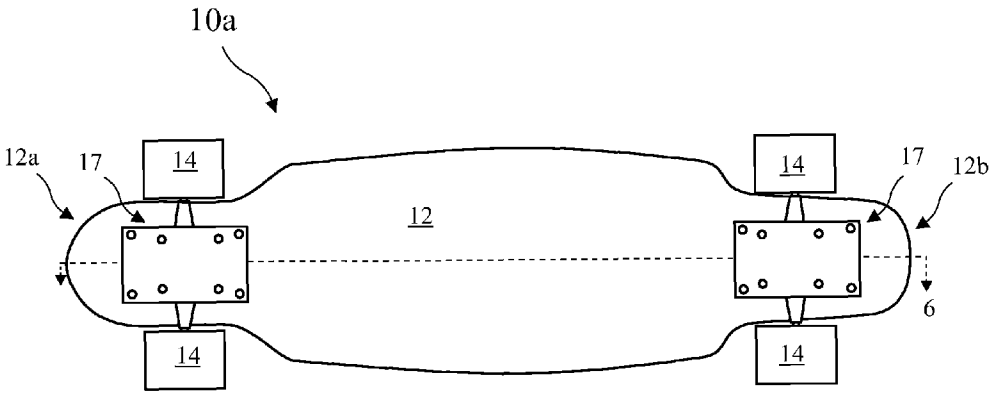
FIG. 3A is a top view of a skateboard according to the present invention.
Figure 3B:
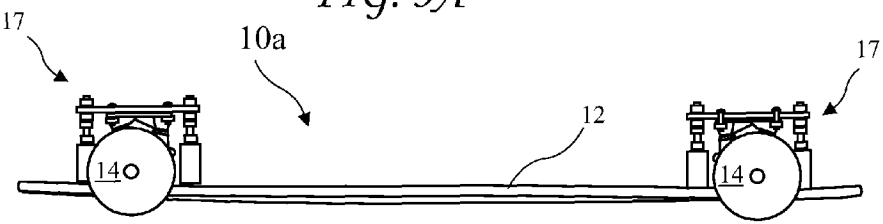
FIG. 3B is a side view of the skateboard according to the present invention.
Figure 3C:
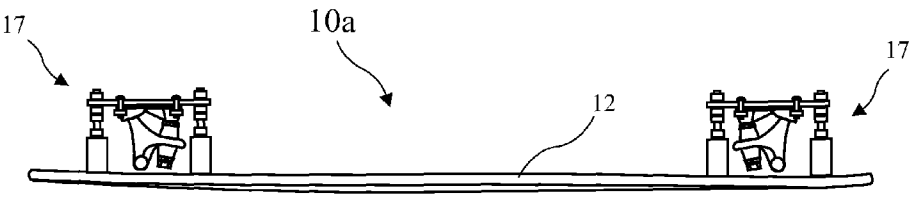
FIG. 3C is a side view of the skateboard according to the present invention with wheels removed.
Figure 3D:
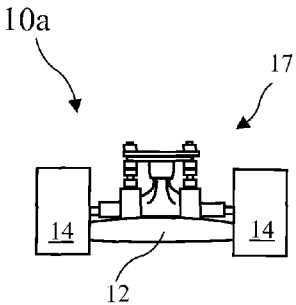
FIG. 3D is a front view of the skateboard according to the present invention.

A top view of a skateboard 10*a* according to the present invention is shown in FIG. 3A, a side view of the skateboard 10*a* is shown in FIG. 3B, a forward (or front) view of the skateboard 10*a* is shown in FIG. 3C, and a rear view of the skateboard 10*a* is shown in FIG. 3D. The skateboard 10*a* includes a passage 13 (see FIGS. 7 and 8) having a forward opening 13*a* at a forward end 12*a* of the deck 12 and a rear opening 13*b* at a rear end 12*b* of the deck 12.

Figure 4A:
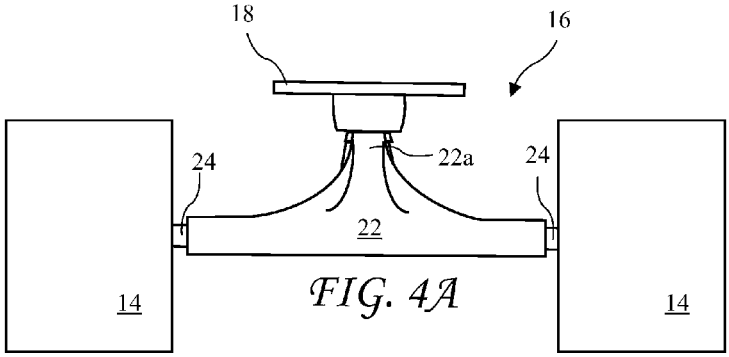
FIG. 4A is a front view of a truck according to the present invention.
Figure 4B:
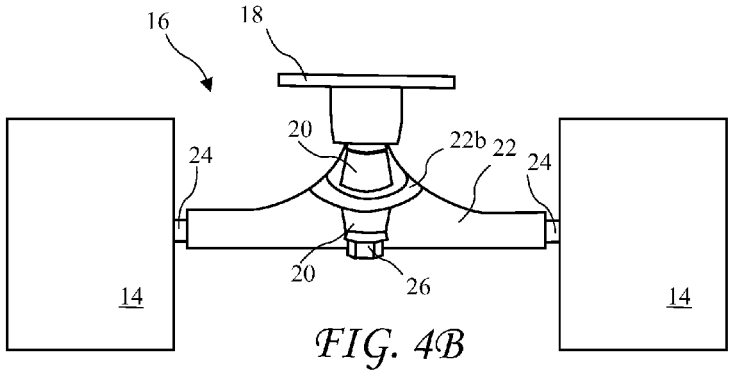
FIG. 4B is a rearview of the truck according to the present invention.
Figure 4D:
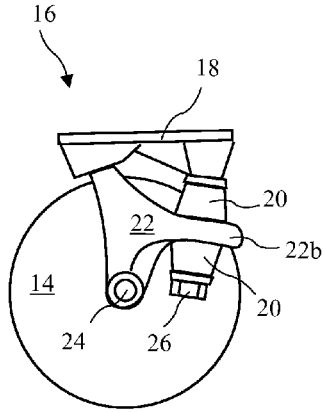
FIG. 4D is a side view of the truck according to the present invention
Figure 4C:
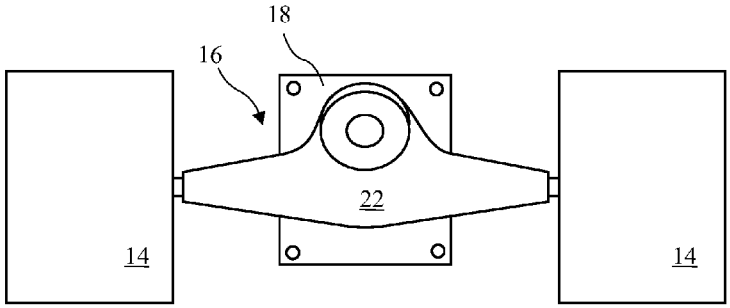
FIG. 4C is a bottom view of the truck according to the present invention.

A front view of a truck 16 according to the present invention is shown in FIG. 4A, a rearview of the truck 16 is shown in FIG. 4B, a bottom view of the truck 16 is shown in FIG. 4C, and is a side view of the truck 16 is shown in FIG. 4D. The truck 16 includes a base plate 18 which attaches to the deck 12 of known skateboards 10, a hanger 22 pivotally engaging the base plate 18 at a pivot end 22*a*, axles 24 reaching laterally from the hanger 22 for mounting the wheels 14, and a kingpin 26 holding the hanger 22 in place. Two bushings 20 reside on the kingpin 26 and sandwich a ring portion 22*b* of the hanger 22. The kingpin 26 may be tightened or loosened (or harder or softer bushings may be selected) to adjust the turning responsiveness of the skateboard.

Figure 5A:
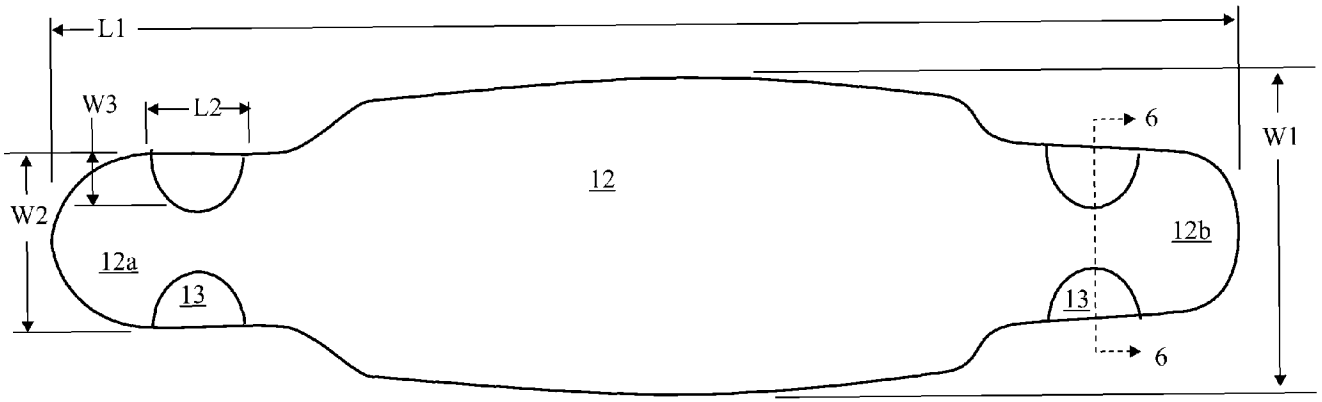
FIG. 5A is a top view of a longboard deck according to the present invention.
Figure 5B:
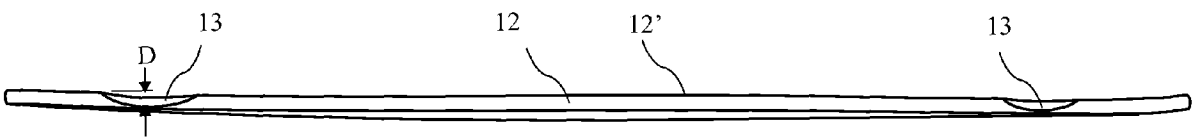
FIG. 5B is a side view of the longboard deck according to the present invention.
Figure 6:
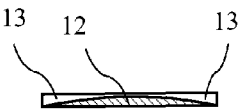
FIG. 6 is a cross-sectional view of the longboard deck according to the present invention taken along line 6-6 of FIG. 5A.

A top view of a deck 12 according to the present invention is shown in FIG. 5A, a side view of the deck 12 is shown in FIG. 5B, and a cross-sectional view of the deck 12 taken along line 6-6 of FIG. 5A is shown in FIG. 6. In one embodiment the deck 12 is a longboard deck having a length L1 of preferably approximately 40 inches and a width W1 of preferably approximately 10 inches. The length and width are only examples and the length and width of a longboard deck may vary according to the preferences of the designer and rider, and a shorter or longer, or wider or narrower longboard deck having truck assemblies according to the present invention is intended to come within the scope of the present invention. In another embodiment the deck is a shortboard deck have correspondingly smaller length and width.

The longboard deck 12 has narrowed front and rear portions 12*a* and 12*b*. The front and rear portions 12*a* and 12*b* have a width W2 slightly narrower than the separation of the wheels 14 and extend behind the front wheels and ahead of the rear wheels to allow clearance for turning.

The top surface 12' includes reliefs 13 in the front and rear portions 12*a* and 12*b* to provide clearance for the hanger 22 when the longboard skateboard 10*a* is turning. The reliefs 13 have a length L2 of preferably at least two inches and more preferably at least 2.5 inches and a width W3 of at least 1.5 inches. The reliefs have a depth D of preferably approximately ⅜ inches at the outside edge of the longboard deck 12 and taper shallower inward and reach inward between 1.5 inches and to the center of the longboard deck 12.

Figure 7B:
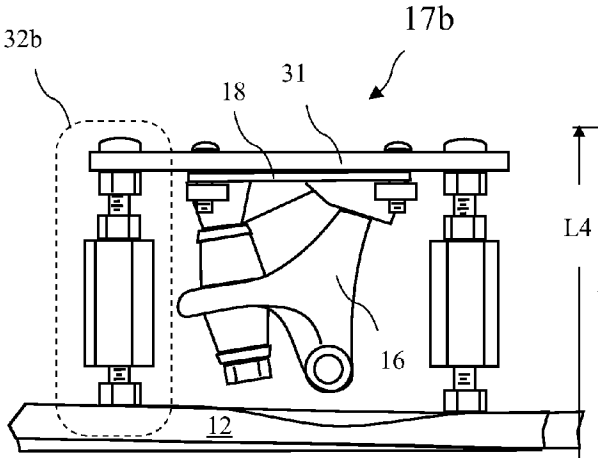
FIG. 7B is a side view of a second truck assembly according to the present invention.
Figure 7A:
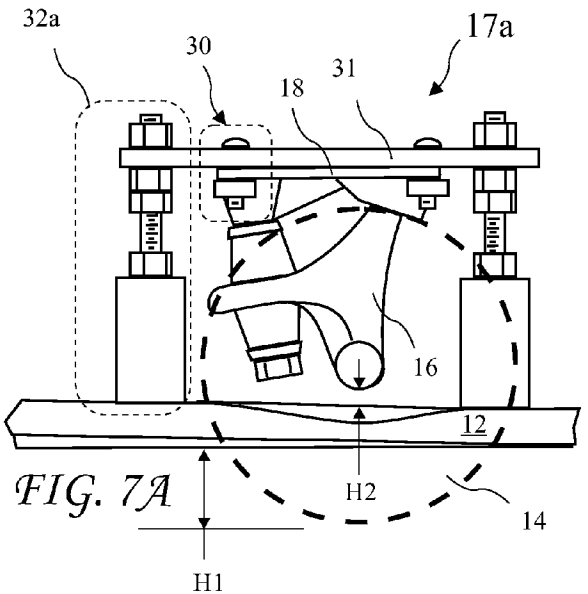
FIG. 7A is a side view of a first truck assembly according to the present invention.

A side view of a first truck assembly 17*a* according to the present invention is shown in FIG. 7A. The first truck assembly 17*a* comprises the truck 16, a truck plate 31, and truck plate supports. The truck plate supports comprise four first fastener assemblies 32*a* at the corners of the truck plate 31 attaching the truck plate 31 to the deck 12. The first fastener assemblies 32*a* are described in detail in FIGS. 1-12. The truck 16 is attached to the truck plate 31 by four fasteners 30, generally comprising a machine screw and nut.

The truck 16 resides between the deck 12 and the truck plate 31. The truck 16 is designed to couple a rotation of the truck 16 about a longitudinal axis into a rotation of the axle 24 about a vertical axis. A rider turns the longboard skateboard 10*a* by leaning the deck 12 to the right or left to turn right or left. Because the rider leans the deck 12 to turn, sufficient height H2 between the truck 16 and the deck 12 must be provided. Additionally, a heavier rider may require greater ground clearance height H1. If the height H1 is increased, the height H2 is reduced. Generally, each rider will adjust the heights H1 and H2 to their preference. The fastener assemblies 32*a* allows such height adjustment as described in FIGS. 10-12.

A side view of a second truck assembly 17*b* according to the present invention is shown in FIG. 7B. The second truck assembly 17*b* allows adjustment of the heights H1 and H2 using the second fastener assemblies 32*b* as described in FIGS. 13-15.

Figure 8:
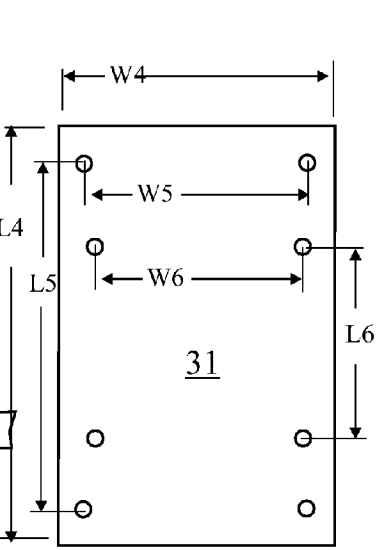
FIG. 8 is a top view of a truck plate of the first and second truck assembly according to the present invention.

A top view of a truck plate 31 of the first and second truck assemblies according to the present invention is shown in FIG. 8. The truck plate 31 preferably has a length L4 of approximately five inches and preferably has a width W4 of approximately 2.5 inches. A set of holes for attachment to the fastener assemblies 32*a* and 32*b* are preferably spaced apart by a length L5 of approximately 4.5 inches and are preferably spaced apart by a width W5 of approximately 1.625 inches. A second set of holes for attaching the truck 16 match the holes present in the truck and are preferably spaced apart by a length L6 of approximately 2.5 inches and are preferably spaced apart by a width W6 of approximately 1.625 inches and preferably match the spacing of holes present in the base plate 18.

Figure 9B:
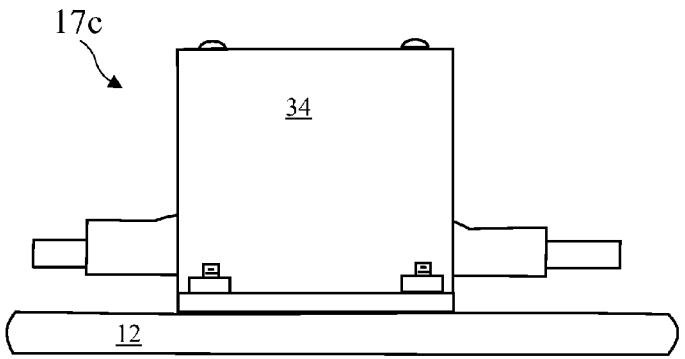
FIG. 9B is a rear view of a third truck assembly according to the present invention.
Figure 9A:
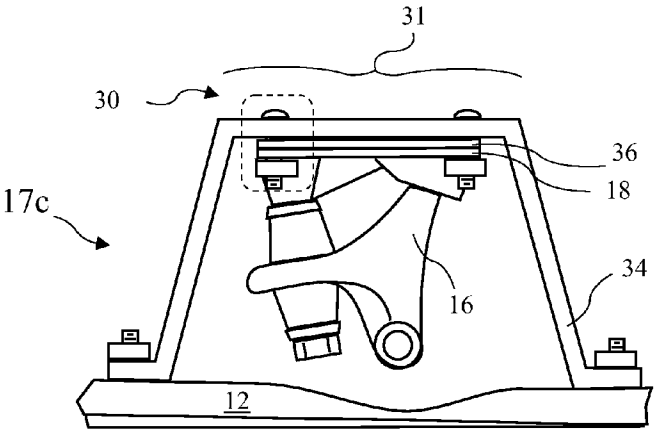
FIG. 9A is a side view of a third truck assembly according to the present invention.

A side view of a third truck assembly 17*c* according to the present invention is shown in FIG. 9A a rear view of a third truck assembly 17*c* is shown in FIG. 9B. The truck assembly 17*c* includes a bent (or otherwise formed) bridge plate 34 which is attached directly to the deck 12 ahead of and behind the truck 16, and reached up and over the truck 16. The truck 16 is attached to a truck plate 31 portion of the bridge plate 34 by fasteners 30, and the bridge plate 34 provides the truck plate support. A spacer 36 resides between the truck plate 31 and the base plate 18. Spacers 36 having different thickness, or multiple spacers 36, may be used to adjust the heights H1 and H2.

Figure 10:
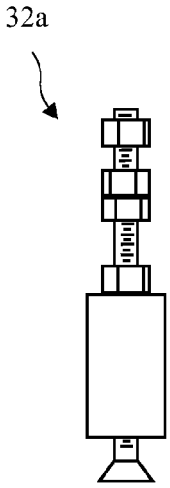
FIG. 10 is a first fastener assembly of the first truck assembly according to the present invention.
Figure 11:
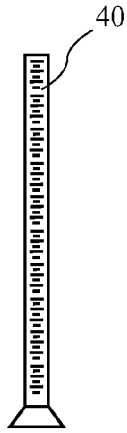
FIG. 11 is a long bolt of the fastener assembly of the first truck assembly according to the present invention.
Figure 12:
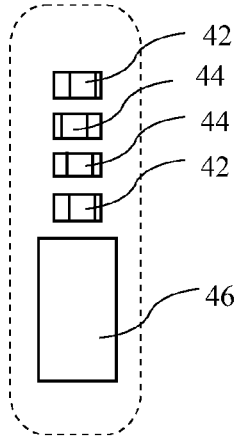
FIG. 12 is a hardware set of the fastener assembly of the first truck assembly according to the present invention.

The fastener assembly 32*a* of the first truck assembly is shown assembled in FIG. 10, a long bolt 40 of the fastener assembly 32*a* is shown in FIG. 11, and a hardware set of the fastener assembly 23*a* is shown in FIG. 12. The long bolt 40 is preferably a four inch long ¼ inch bolt, but may be a larger size bolt for added strength. Spacers 46 are sandwiched between lock nuts (for example nylon lock nuts) 42 and the deck 12. The truck plate 31 and truck base plate 18 and is sandwiched between a lock nut 42 on top of the truck plate 31, and a pair of nuts 44. The lock nut 42 and pair of nuts 44 may be loosened and adjusted to adjusted the heights H1 and H2.

Figure 13:
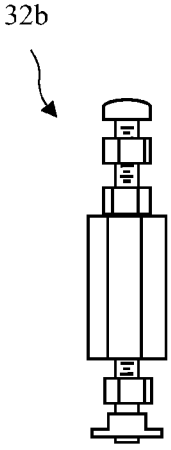
FIG. 13 is a second fastener assembly of the second truck assembly according to the present invention.
Figure 14:
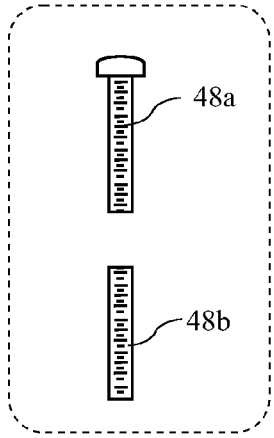
FIG. 14 is a long bolt of the fastener assembly of the second truck assembly according to the present invention.
Figure 15:
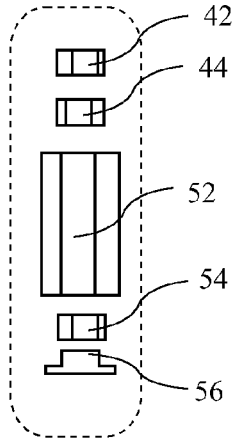
FIG. 15 is a hardware set of the fastener assembly of the second truck assembly according to the present invention.

A second fastener assembly 32*b* of the second truck assembly 17*b* according to the present invention is shown in FIG. 13, bolt segments 48*a* and 48*b* of the fastener assembly 32*b* are shown in FIG. 14, and a hardware set of the second fastener assembly 32*b* is shown in FIG. 15. The fastener assembly 32*b* includes a turnbuckle nut 52 having left and right hand threads at opposite ends, and the corresponding bolt segments 48*a* and 48*b* are right and left hand threaded. The nut 54 and T-nut 56 have the same thread as the segment 48*b*. A lock nut 42 and nut 44 have the same thread as the segment 48*a*. The heights H1 and H2 are adjusted by loosening the nut 44 and turning the turnbuckle nut 52.

Washers may be included between any of the nuts 42, 44, 52, and 54 and any surfaces they are in contact with.

While the invention herein disclosed has been described by means of specific embodiments and applications thereof, numerous modifications and variations could be made thereto by those skilled in the art without departing from the scope of the invention set forth in the claims.

I claim:

1. A skateboard comprising:

a deck having a top surface and narrow front and rear portions;

truck assemblies attached to the longboard deck, the truck assemblies comprising:

truck carriers comprising truck plates and truck plate supports, the truck plates spaced apart from top surface of the deck; and trucks attached to the truck plates and residing between the truck plates and the top surface of the deck, the truck assemblies providing clearance between the trucks and the top surface of the deck allowing the skateboard to turn; and wheels attached to the trucks, wherein the truck assemblies include adjustable length fastener assemblies connecting the truck plates to the deck to adjust the clearance between the trucks and the deck.

2. The skateboard of claim 1, wherein four adjustable length fastener assemblies are attached to the truck plates to adjust the clearance between the trucks and the deck.

3. The skateboard of claim 1, wherein truck assemblies include truck bridges fixedly attached to the deck and removable and replaceable spacers between the truck plate portion of the truck bridges and the trucks to adjust the clearance between the trucks and the deck.

4. The skateboard of claim 1, further including reliefs on the top surface of the deck aligned with truck axles, the reliefs reaching to outside edges of the deck.

5. The skateboard of claim 4, wherein the reliefs extend at least two inches along edges of the deck.

6. The skateboard of claim 5, wherein the reliefs extend about 2.5 inches along edges of the deck.

7. The skateboard of claim 5, wherein the reliefs reach at least 1.5 inches inward from the edges of the deck.

8. The skateboard of claim 4, wherein the reliefs taper to a maximum depth of about ⅜ inches at the edges of the deck.

9. The skateboard of claim 4, wherein the deck is a longboard deck.

10. The skateboard of claim 4, wherein the deck is a shortboard deck.

11. The skateboard of claim 1, wherein the adjustable length fastener assemblies are threaded having nuts which may be loosened and adjusted to adjust the clearance between the trucks and the deck.

12. A skateboard comprising:

a deck having a top surface and narrow front and rear portions;

adjustable truck assemblies attached to the narrow front and rear portions of the longboard deck, the truck assemblies comprising:

truck carriers including truck plate portions, the truck plate portions spaced apart from, and above, the top surface of the deck; and trucks attached to the truck plate portions and residing between the truck plate portions and the top surface of the deck, the truck assemblies adjustable by adjustable length fasteners connecting the truck carriers to the deck to adjust the clearance between the trucks and the deck to providing a desired clearance between the trucks and the top surface of the deck allowing the skateboard to turn; and wheels attached to the trucks and residing fully outside the narrow front and rear portions of the longboard deck.

13. The skateboard of claim 12, wherein four adjustable length fastener assemblies are attached to the truck plates to adjust the clearance between the trucks and the deck.

14. The skateboard of claim 12, wherein the adjustable length fastener assemblies are threaded having nuts which may be loosened and adjusted to adjust the clearance between the trucks and the deck.

15. The skateboard of claim 12, wherein truck assemblies include truck bridges fixedly attached to the deck and removable and replaceable spacers between the truck plate portion of the truck bridges and the trucks to adjust the clearance between the trucks and the deck.

16. The skateboard of claim 12, wherein the deck is a longboard deck.

17. The skateboard of claim 12, wherein the deck is a shortboard deck.

18. A skateboard comprising:

a skateboard deck having a top surface;

trucks including base plates for mounting the trucks;

wheels attached to the trucks and residing laterally outside front and rear portions of the deck;

truck carriers including truck mounting surfaces spaced apart from, facing, and above, the top surface of the deck, when the truck carriers are attached to the deck; and the base plates of the trucks attached to the truck mounting surfaces of the truck carriers, the trucks residing between the truck mounting surfaces and the top surface of the deck.

19. The skateboard of claim 18, wherein the truck carriers are adjustable to adjust the clearance between the trucks and the deck.

20. The skateboard of claim 19, wherein track carriers include adjustable length fastener assemblies connecting the truck carriers to the deck to adjust the clearance between the trucks and the deck.

21. The skateboard of claim 18, further including reliefs on the top surface of the deck aligned with truck axles, the reliefs reaching to outside edges of the deck, the reliefs extend at least two inches along edges of the deck and reaching at least 1.5 inches inward from the edges of the deck.

* * * * *